US008419396B2

(12) United States Patent
Yasuzaka et al.

(10) Patent No.: US 8,419,396 B2
(45) Date of Patent: Apr. 16, 2013

(54) VANE PUMP AND EVAPORATIVE LEAK CHECK SYSTEM HAVING THE SAME

(75) Inventors: Taiki Yasuzaka, Kariya (JP); Mitsuyuki Kobayashi, Gamagori (JP); Hitoshi Amano, Okazaki (JP)

(73) Assignee: Denso Corporation, Kariya (JP)

( * ) Notice: Subject to any disclaimer, the term of this patent is extended or adjusted under 35 U.S.C. 154(b) by 303 days.

(21) Appl. No.: 12/941,122

(22) Filed: Nov. 8, 2010

(65) Prior Publication Data

US 2011/0123371 A1 May 26, 2011

(30) Foreign Application Priority Data

Nov. 25, 2009 (JP) ..... 2009-267241

(51) Int. Cl.
*F03C 2/00* (2006.01)
*F03C 4/00* (2006.01)
*F04C 15/00* (2006.01)

(52) U.S. Cl.
USPC ..... 418/133; 418/131; 418/152; 418/259; 418/268; 73/118.1

(58) Field of Classification Search ..... 418/166–268, 418/152–153, 131, 133; 73/118.1
See application file for complete search history.

(56) References Cited

U.S. PATENT DOCUMENTS 4,050,855 A * 9/1977 Sakamaki et al. ..... 418/153
4,286,933 A * 9/1981 Sakamaki et al. ..... 418/133
5,688,203 A 11/1997 Yamamoto et al.
7,993,119 B2 * 8/2011 Kobayashi et al. ..... 418/133
2009/0148329 A1 6/2009 Kobayashi et al.

FOREIGN PATENT DOCUMENTS

JP P2006-22718 A 1/2006
JP 2009138602 A * 6/2009

OTHER PUBLICATIONS

Japanese Office Action dated Nov. 29, 2011, issued in corresponding Japanese Application No. 2009-267241 with English Translation.

* cited by examiner

*Primary Examiner* — Theresa Trieu
(74) *Attorney, Agent, or Firm* — Nixon & Vanderhye PC

(57) ABSTRACT

An upper casing receives a rotor, which is rotated by a drive force of a motor. The upper casing includes a pump chamber, which receives the rotor, a planar surface portion, which is formed around an opening of the pump chamber, and a through hole. A lower casing includes a planar surface portion, which is formed around the opening of the pump chamber, and a through hole. The lower casing closes the opening of the pump chamber to form the pump chamber in cooperation with the upper casing. A resilient sheet is placed between the lower casing and a mount portion of the motor and includes a through hole. A screw is received through the through holes of the upper casing, the lower casing and the resilient sheet to securely connect the upper casing, the lower casing and the resilient sheet to the mount portion. A lower casing side surface of the resilient sheet includes a plurality of primary protrusions.

6 Claims, 6 Drawing Sheets

VANE PUMP AND EVAPORATIVE LEAK CHECK SYSTEM HAVING THE SAME

CROSS REFERENCE TO RELATED APPLICATION

This application is based on and incorporates herein by reference Japanese Patent Application No. 2009-267241 filed on Nov. 25, 2009.

BACKGROUND OF THE INVENTION

1. Field of the Invention

The present invention relates to a vane pump and an evaporative leak check system having the same.

2. Description of Related Art

In a known vane pump, a rotor having a plurality of vanes is rotated to pressurize and discharge fluid upon pressurization thereof. For example, Japanese Unexamined Patent Publication. No. 2009-138602A (corresponding to US 2009/0148329A1) teaches such a vane pump that is used to depressurize or pressurize an interior of a fuel tank in an evaporative leak check system that is used to check leakage of fuel vapor from the fuel tank. The performance of the evaporative leak check system is often influenced by a pump performance of the vane pump.

In this vane pump, a pump chamber is formed between the upper casing and the lower casing, and a rotor having vanes is rotatably received in the pump chamber. The upper casing and the lower casing are secured to a mount portion of the motor with screw members. A resilient sheet is placed between the lower casing and the mount portion of the motor. A reaction force is generated in the resilient sheet in response to a tightening force of the screws. When this reaction force is applied, the lower casing is urged against the upper casing to tightly contact against the upper casing. In this way, a fluid tightness (gas tightness or liquid tightness) of the pump chamber is improved.

The resilient sheet of the vane pump, which is disclosed in Japanese Unexamined Patent Publication No. 2009-138602A (corresponding to US 2009/0148329A1), is made of a planar resilient member having two opposed smooth planar surfaces, which are opposed to each other in a direction perpendicular to the plane of the sheet. Therefore, the reaction force, which is generated in the resilient sheet, may vary from product to product in a span of control of the tightening force generated by the screws at the time of manufacturing. When the reaction force of the resilient force substantially varies from the product to product, the fluid tightness (gas tightness or liquid tightness) of the pump chamber may possibly be excessively reduced or excessively increased. In such a case, it is difficult to place a suction pressure or discharge pressure of the vane pump immediately after the manufacturing thereof in a predetermined factory standard range thereof.

Furthermore, when a thickness of the resilient sheet is increased to reduce the amount of change (variation) in the reaction force, the size and costs of the resilient sheet may possibly be disadvantageously increased.

SUMMARY OF THE INVENTION

The present invention addresses the above disadvantages. According to the present invention, there is provided a vane pump, which includes an electric motor, a rotor, an upper casing, a lower casing, a resilient sheet and a screw member. The electric motor includes a mount portion. The rotor includes a plurality of vanes and is adapted to be rotated together with the plurality of vanes by a rotational drive force of the electric motor. The upper casing rotatably receives the rotor and includes a pump chamber, a primary planar surface portion and a primary through hole. The pump chamber has an inner peripheral wall, along which the plurality of vanes slides to draw fluid into the pump chamber and to discharge the fluid pressurized in the pump chamber out of the pump chamber upon rotation of the rotor. The primary planar surface portion is formed around an opening of the pump chamber. The primary through hole penetrates through the primary planar surface portion. The lower casing includes a secondary planar surface portion and a secondary through hole. The secondary planar surface portion is joined to the primary planar surface portion. The secondary through hole extends through the secondary planar surface portion at a location, which corresponds to the primary through hole. The lower casing closes the opening of the pump chamber to form the pump chamber in cooperation with the upper casing. The resilient sheet is placed between the lower casing and the mount portion and includes a tertiary through hole at a location, which corresponds to the secondary through hole. The screw member is received through the primary through hole, the secondary through hole and the tertiary through hole to securely connect the upper casing, the lower casing and the resilient sheet to the mount portion. At least one of two opposed surfaces of the resilient sheet, which are opposed to each other in a direction perpendicular to a plane of the resilient sheet, includes a plurality of primary protrusions.

According to the present invention, there is also provided an evaporative leak check system including the vane pump discussed above. The vane pump is adapted to depressurize or pressurize an interior of a fuel tank to check leakage of fuel vapor from the fuel tank.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
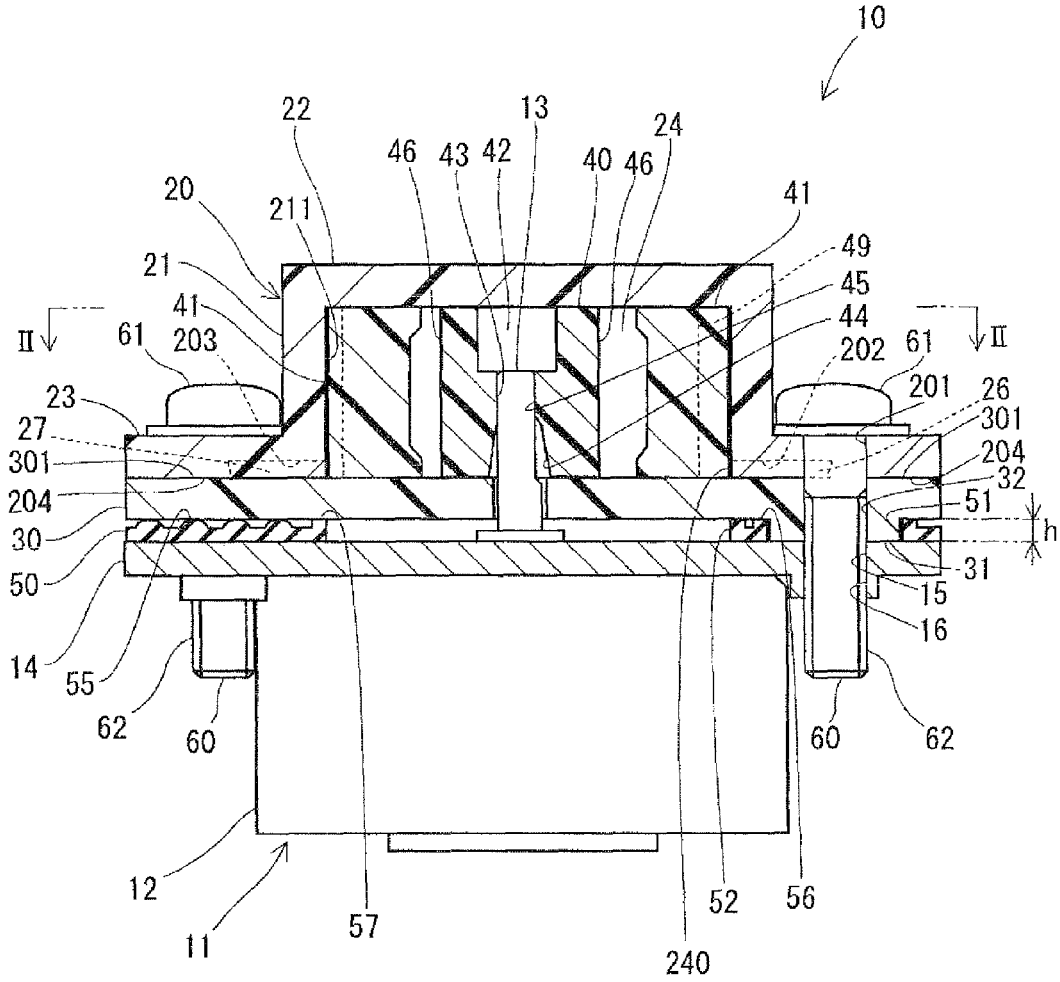
FIG. 1 is a schematic cross sectional view of a vane pump according to a first embodiment of the present invention.

Embodiments of the present invention will be described with reference to the accompanying drawings. In the following embodiments, similar components will be indicated by the same reference numerals and will not be described redundantly for the sake of simplicity.

First Embodiment

Figure 2:
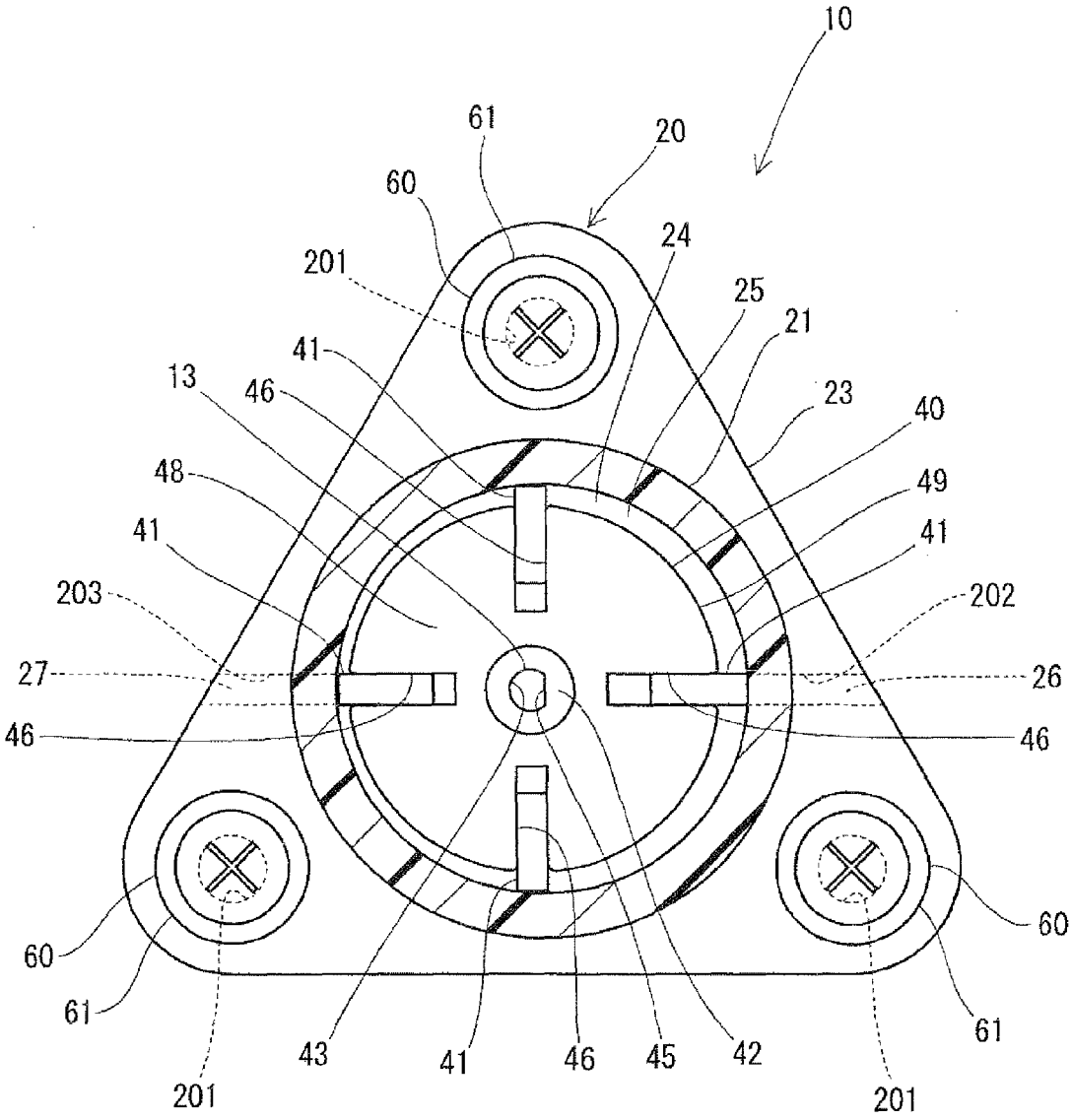
FIG. 2 is a cross sectional view taken along line II-II in FIG. 1.
Figure 3A:
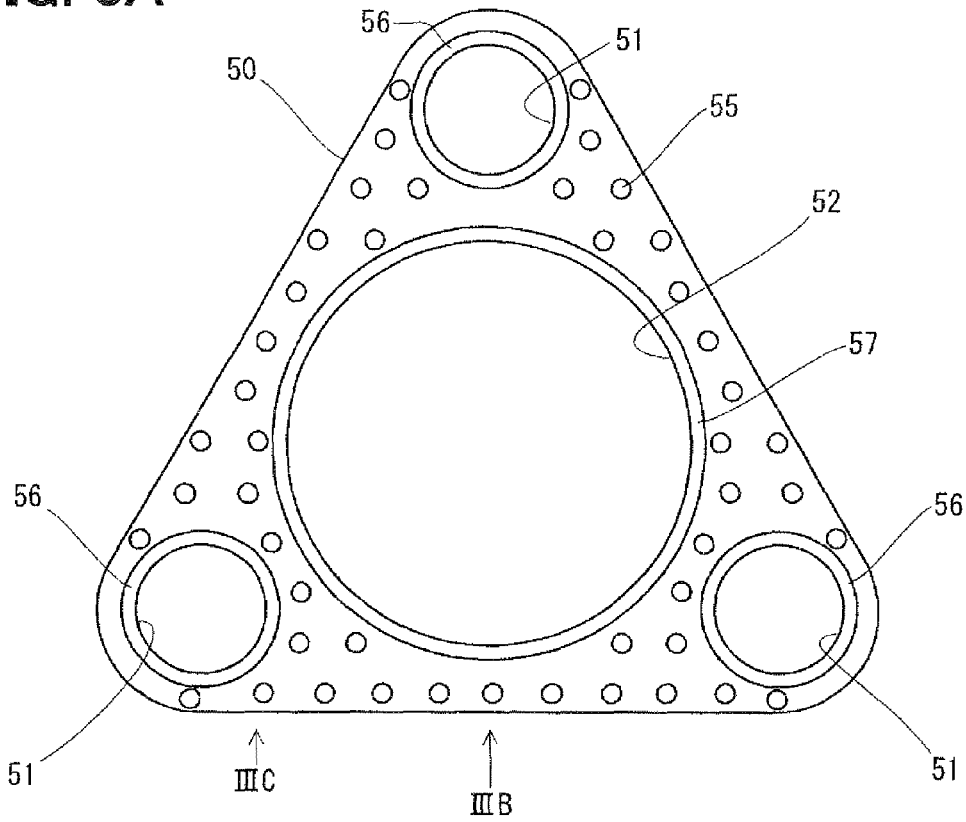
FIG. 3A is a plan view of a resilient sheet of the vane pump of the first embodiment.
Figure 3B:
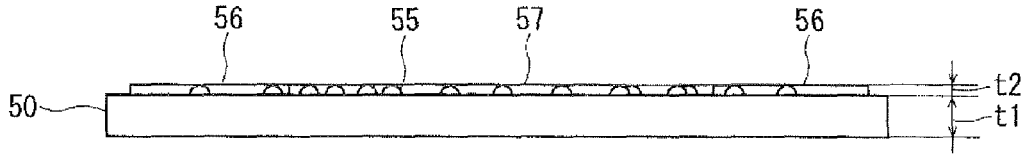
FIG. 3B is a side view taken in a direction of IIIB in FIG. 3A.
Figure 3C:
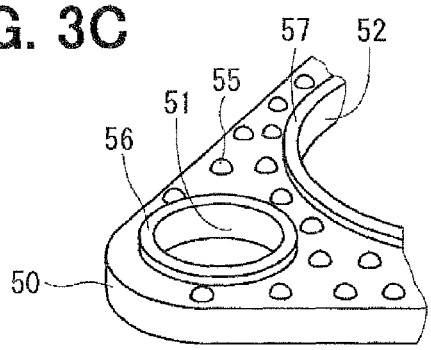
FIG. 3C is a partial perspective view taken in a direction of an arrow IIIC in FIG. 3A.

FIGS. 1 to 3 show a vane pump according to a first embodiment of the present invention. The vane pump 10 pressurizes fluid upon drawing the same and discharges the pressurized fluid. The fluid to be pressurized by the vane pump 10 may be any appropriate fluid, such as gas (e.g., air) or liquid (e.g., water).

The vane pump 10 includes an electric motor 11, a rotor 40, an upper casing 20, a lower casing 30, a resilient sheet (elastic sheet) 50 and screw 60. The rotor 40 of the vane pump 10 is driven by the motor 11, which is placed such that the lower casing 30 and the resilient sheet 50 are held between the rotor 40 and the motor 11. The motor 11 may be a direct current electric motor or an alternating current electric motor. The motor 11 includes a cover (housing) 12, a shaft 13 and a mount portion 14. The cover 12 receives a stator (not shown). The shaft 13 is rotatable together with a rotor (not shown) received in the cover 12. The upper casing 20, the lower casing 30 and the resilient sheet 50 are installed to the mount portion 14.

The upper casing 20 includes a tubular portion 21, a plate portion 22 and a flange portion 23 and is formed integrally from, for example, a resin material. The tubular portion 21 is configured into a generally cylindrical tubular form. An inner peripheral wall 211 of the tubular portion 21 is configured to have a generally cylindrical surface. An opening of one end part of the tubular portion 21 is closed with the plate portion 22, which is generally planar. The flange portion 23 is formed at the other end part of the tubular portion 21 to radially outwardly project. A planar surface portion (serving as a primary planar surface portion) 204 is formed in an end surface of the flange portion 23, which is opposite from the plate portion 22 in the axial direction. Thereby, the upper casing 20 is configured into the cup-shaped body having the peripheral wall (wall of the tubular portion 21) and the bottom wall (wall of the plate portion 22).

The Upper casing 20 includes a plurality of through holes (serving as primary holes) 201, which penetrate through the planar surface portion 204 in the axial direction. That is, the through holes 201 are formed to extend through the flange portion 23 of the upper casing 20 in the axial direction. In the present embodiment, the through holes 201 of the flange portion 23 include three through holes 201.

The lower casing 30 is configured into a plate form (i.e., being generally planar) and is made of, for example, a resin material. A planar surface portion (serving as a secondary planar surface portion) 301 is formed in an end surface of the lower casing 30, which is located on the upper casing 20 side in the axial direction. The planar surface portion 301 is securely connected to or joined to the planar surface portion 204 of the upper casing 20. In this way, the lower casing 30 covers an opening at the other end part of the tubular portion 21, which is opposite from the one end part of the tubular portion 21 in the axial direction. Thereby, at a radially inner side of the tubular portion 21, a pump chamber 24 is defined by the tubular portion 21 and the plate portion 22 of the upper casing 20 and the lower casing 30. Specifically, an opening 240 of the pump chamber 24 of the upper casing 20 is closed with the lower casing 30.

The lower casing 30 includes a plurality of through holes (serving as secondary through holes) 32 that axially penetrate through the planar surface portion 301 at corresponding locations, respectively, which corresponds to the through holes 201, respectively, of the upper casing 20. Furthermore, the lower casing 30 includes a plurality of projections 31, each of which axially projects toward the motor 11 side, Each projection 31 is formed into a generally annular form and circumferentially extends along the peripheral edge of the opening of the corresponding through hole 32. That is, the through hole 32 is formed at the location radially inward of the projection 31.

The rotor 40 is configured into a generally cylindrical form and is made of, for example, a resin material. The rotor 40 is rotatably received in the pump chamber 24. Thereby, a space 25 is defined by the tubular portion 21 and the plate portion 22 of the upper casing 20, the lower casing 30 and the rotor 40 (see FIG. 2). In the present embodiment, the rotor 40 is eccentric to a center axis of the tubular portion 21. Therefore, a volume (radial size) of the space 25, which is radially defined between the tubular portion 21 and the rotor 40, changes in the circumferential direction. The space 25 is communicated with a fluid inlet passage 26 and a fluid outlet passage 27. The fluid inlet passage 26 and the fluid outlet passage 27 radially outwardly extend from the space 25. The fluid inlet passage 26 is formed between a groove 202 of the flange portion 23 and the lower casing 30. The fluid outlet passage 27 is formed between a groove 203 of the flange portion 23 and the lower casing 30.

A recess 42 and a center hole 43 are formed in a center part of the rotor 40. The recess 42 is recessed from an end surface of the rotor 40, which is located at the plate portion 22 side, to an axial intermediate part of the rotor 40. Thereby, the recess 42 serves as a material (resin) volume reducing part, which reduces the material (resin) of the rotor 40. The center hole 43 extends through the rotor 40 in a thickness direction (axial direction parallel to the rotational axis) of the rotor 40. Therefore, the center hole 43 connects between the recess 42 of the rotor 40 and the lower casing 30 side of the rotor 40. The center hole 43 includes a tapered hole (tapered hole section) 44, which has a diameter that is progressively reduced from a lower casing 30 side end part to an axial intermediate part of the center hole 43. Furthermore, the center hole 43 also includes a non-circular hole (non-circular hole section) 45, which has a non-circular cross section and extends from the axial intermediate part of the center hole 43 to the recess 42.

The shaft 13 of the motor 11 is received in the center hole 43. When the shaft 13 is inserted into the center hole 43 of the rotor 40, the shaft 13 is guided along the tapered hole 44 and is then received into the non-circular hole 45. The cross section of the shaft 13 generally coincides with the cross section of the non-circular hole 45 in an axial range between the axial intermediate part of the shaft 13 to the recess 42 side end part of the shaft 13. The cross-sectional area of the non-circular hole 45 is larger than the cross-sectional area of the end part of the shaft 13. That is, a radial gap exists between the inner peripheral wall of the rotor 40, which forms the non-circular hole 45, and the outer peripheral wall of the shaft 13. Therefore, the shaft 13 is loosely fitted to the rotor 40 while the cross section of the shaft 13 corresponds to the cross section of the non-circular hole 45. With this loose fit, when the shaft 13 is rotated, the shaft 13 is rotated together with the rotor 40 without causing relative rotation of the shaft 13 relative to the rotor 40. At this time, the rotor 40 could swing or wobble such that the axis of the rotor 40 is tilted.

The rotor 40 has a plurality of vane receiving grooves 46, each of which is radially inwardly recessed from the outer peripheral surface of the rotor 40. Each vane receiving groove 46 axially extends to connect between the lower casing 30 side end surface and the plate portion 22 side end surface of the rotor 40. In the present embodiment, the vane receiving grooves 46 include four vane receiving grooves 46, which are arranged one after another at generally equal intervals in the circumferential direction of the rotor 40. In the rotor 40, each vane receiving groove 46 receives a corresponding one of a plurality of vanes 41. The rotor 40 is eccentric to the inner peripheral wall 211 of the tubular portion 21. Therefore, a radial distance between the rotor 40 and the inner peripheral wall 211 of the tubular portion 21 changes in response to the rotation of the rotor 40. When the rotor 40 is rotated, each vane 41 is radially outwardly pulled by the centrifugal force until the vane 41 contacts the inner peripheral wall 211. When the radial distance between the rotor 40 and the inner peripheral wall 211 of the tubular portion 21 is reduced, each corresponding vane 41 is radially inwardly urged in the corresponding vane receiving groove 46. Thereby, when the rotor 40 is rotated, each vane 41 is rotated together with the rotor 40 while the radially outer end part of each vane 41 slidably contacts the inner peripheral wall 211 of the tubular portion 21. Also, at this time, each vane 41 is reciprocated in the vane receiving groove 46 as the rotor 40 is rotated.

The resilient sheet 50 is placed between the lower casing 30 and the mount portion 14 of the motor 11. The resilient sheet 50 is configured into a plate form (sheet form) and is formed from a material (e.g., rubber), which has a resiliency and a large attenuation coefficient. The resilient sheet 50 has three through holes (serving as tertiary through holes) 51 that are provided at three locations, respectively, which correspond to the through holes 32, respectively, of the lower casing 30. An inner diameter of each through hole 51 is generally the same as or slightly larger than the outer diameter of the corresponding projection 31.

As shown in FIGS. 1 and 3A-3C, the resilient sheet 50 includes a plurality of primary protrusions 55 on a lower casing 30 side surface of the resilient sheet 50. Each primary protrusion 55 is configured into a generally semispherical form and protrudes toward the lower casing 30 side in the axial direction. Furthermore, the resilient sheet 50 further includes a plurality of secondary protrusions 56 on the lower casing 30 side surface of the resilient sheet 50, on which the primary protrusions 55 are formed. A projecting height of each secondary protrusion 56 measured in the axial direction is generally the same as that of the primary protrusion 55. The secondary protrusion 56 is configured into a generally annular form, which circumferentially extends along a peripheral edge of the opening of the corresponding through hole 51. That is, the through hole 51 is formed radially inward of the secondary protrusion 56.

Furthermore, the resilient sheet 50 has a center through hole 52 that axially penetrates through the resilient sheet 50 at a corresponding location which corresponds to the pump chamber 24. A shape of the center through hole 52 corresponds to a shape of the opening 240 of the pump chamber 24, i.e., the shape of the opening of the end part of the tubular portion 21 at the lower casing 30 side. Thereby, the resilient sheet 50 is configured into the shape, which corresponds to the shape of the planar surface portion 204 of the upper casing 20. Furthermore, the resilient sheet 50 further includes a tertiary protrusion 57 on the lower casing 30 side surface of the resilient sheet 50 where the primary protrusions 55 are formed. A protruding height of the tertiary protrusion 57 measured in the axial direction is generally the same as that of the primary protrusion 55. The tertiary protrusion 57 is configured into a generally annular form and surrounds an opening of the center through hole 52, i.e., circumferentially extends along a peripheral edge of the opening of the center through hole 52. That is, the through hole 52 is formed radially inward of the tertiary protrusion 57.

As shown in FIG. 1, each of a plurality of screws (serving as screw members) 60 has a head 61 at one end part thereof. A male thread 62 is formed along an outer peripheral surface of the screw 60 to extend from the other end part of the screw 60, which is opposite from the head 61, to an axial intermediate part of the screw 60. The mount portion 14 of the motor 11 is made of, for example, a metal material. The mount portion 14 has three mount holes 15 at three locations, respectively, which correspond to the through holes 201, respectively, of the upper casing 20. A female thread 16, which corresponds to the male thread 62 of the corresponding screw 60, is formed in an inner peripheral wall of each mount hole 15 of the mount portion 14.

Each screw 60 is received through the corresponding through hole 201 of the upper casing 20, the corresponding through hole 32 of the lower casing 30 and the corresponding through hole 51 of the resilient sheet 50 and is threadably engaged with the mount hole 15 of the mount portion 14. In this way, the upper casing 20, the lower casing 30 and the resilient sheet 50 are held between the head 61 of each screw 60 and the mount portion 14 and are thereby securely fitted to the mount portion 14. At this time, an axial force (tightening force of the screw 60) is exerted between the head 61 of the screw 60 and the mount portion 14. Therefore, the resilient sheet 50 is urged by the lower casing 30 and the mount portion 14, so that the resilient sheet 50 is compressed in the axial direction. Thereby, a reaction force is generated at the resilient sheet 50, so that the lower casing 30 receives the pressure from the resilient sheet 50 toward the upper casing 20. As a result, the planar surface portion 301 of the lower casing 30 tightly contacts the planar surface portion 204 of the upper casing 20. Thus, the fluid tightness (the gas tightness or liquid tightness) of the pump chamber 24 is maintained.

The projections 31 of the lower casing 30 are received through the through holes 51, respectively, of the resilient sheet 50 and contact the mount portion 14. A projecting amount h of each projection 31 is set to be smaller than a sum of a thickness t1 of the resilient sheet 50 and the protruding height t2 of each primary protrusion 55 measured in a non-compressed state, i.e., a relaxed state of the resilient sheet 50 (see FIGS. 1 and 3B). Therefore, when the projection 31 contacts the mount portion 14, the resilient sheet 50 is clamped between and is compressed between the lower casing 30 and the mount portion 14. In this way, the lower casing 30 receives the pressure, which is generated by the reaction force of the resilient sheet 50, and the distance between the lower casing 30 (other than the projections 31) and the mount portion 14 is kept constant, i.e., kept to the projecting amount h of the projection 31.

Next, with reference to FIGS. 4A to 4D, the vane pump 10 of the present embodiment will be discussed in comparison with a vane pump (comparative vane pump) of a comparative example. The comparative vane pump is similar to the vane pump 10 of the present embodiment except the structure of the resilient sheet. The resilient sheet of the comparative example has no comparative protrusion, which is comparative to the protrusions 55-57 of the vane pump 10. Thus, the resilient sheet of the comparative example is formed as a planar sheet having two axially opposed smooth planar surfaces.

Figure 4A:
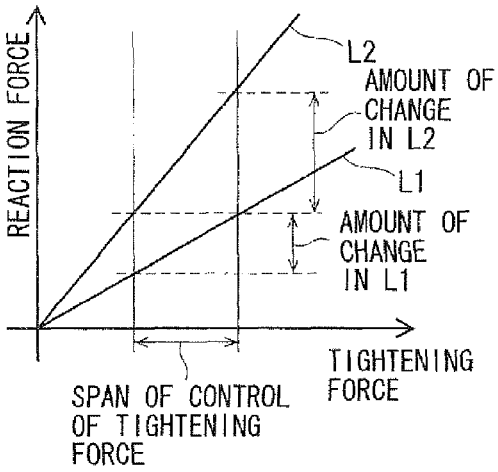
FIG. 4A is diagram showing a relationship between a tightening force of a screw member and the reaction force of the resilient sheet of a vane pump of a comparative example.
Figure 4B:
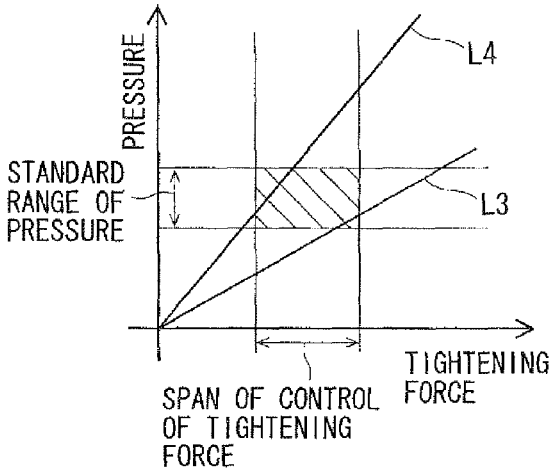
FIG. 4B is a diagram showing a relationship between the tightening force of the screw member and a suction pressure or discharge pressure of the vane pump of the comparative example.

FIG. 4A shows a relationship between a tightening force of the screw (screw member) and the reaction force of the resilient sheet in the comparative example. In FIG. 4A, a line L1 indicates a case where the thickness of the resilient sheet is large, and a line L2 indicates a case where the thickness of the resilient sheet is small. FIG. 4B shows a relationship between the tightening force of the screw member and a suction pressure or discharge pressure (indicated as pressure in FIG. 4B) of the vane pump in the comparative example. In FIG. 4B, a line L3 indicates the case where the thickness of the resilient sheet is large, and a line L4 indicates the case where the thickness of the resilient sheet is small.

Figure 4C:
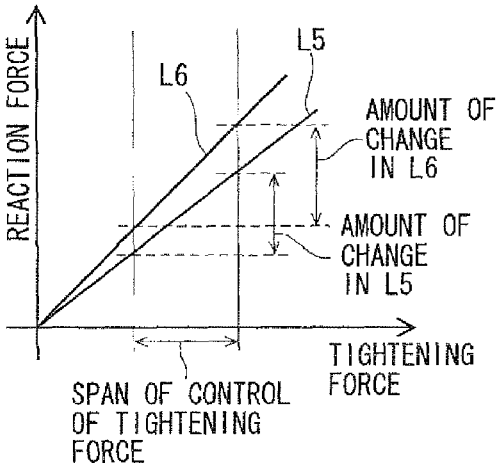
FIG. 4C is a diagram showing a relationship between a tightening force of a screw member and a reaction force of the resilient sheet of the first present embodiment.
Figure 4D:
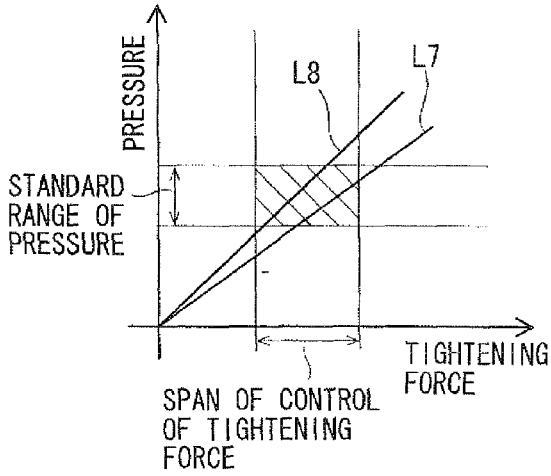
FIG. 4D is a diagram showing a relationship between the tightening force of the screw member and the suction pressure or discharge pressure of the vane pump of the first embodiment.

FIG. 4C shows a relationship between a tightening force of the screw 60 and a reaction force of the resilient sheet 50 of the present embodiment. In FIG. 4C, a line L5 indicates the case where the thickness of the resilient sheet 50 is large, and a line L6 indicates the case where the thickness of the resilient sheet 50 is small. FIG. 4D shows a relationship between the tightening force of the screw 60 and a suction pressure or discharge pressure (indicated as pressure in FIG. 4D) of the vane pump 10 of the present embodiment. In FIG. 4D, a line L7 indicates the case where the thickness of the resilient sheet 50 is large, and a line L8 indicates the case where the thickness of the resilient sheet 50 is small.

As clearly understood from FIG. 4A, in the case of the comparative example, there is a large difference between the amount of change in the reaction force generated in response to the tightening force of the screw member in the case of L1 (large thickness of the resilient sheet) and the amount of change in the reaction force generated in response to the tightening force of the screw member in the case of L2 (small thickness of the resilient sheet). Therefore, as shown in FIG. 4B, there is also a large difference between the amount of change in the pressure of the vane pump in response to the degree of the reaction force of the resilient sheet in the case of L3 and the amount of change in the pressure of the vane pump in response to the degree of the reaction force of the resilient sheet in the case of L4. Thus, in the case of the comparative example, it is difficult to place the suction pressure or discharge pressure of the vane pump immediately after manufacturing thereof in a predetermined factory standard range thereof in a span of control of the tightening force of the screw member (see FIG. 4B).

In contrast, as clearly understood from FIG. 4C, in the case of the present embodiment, there is a small difference between the amount of change in the reaction force generated in response to the tightening force of the screw 60 in the case of L5 (large thickness of the resilient sheet 50) and the amount of change in the reaction force generated in response to the tightening force of the screw 60 in the case of L6 (small thickness of the resilient sheet). Therefore, as shown in FIG. 4D, there is also a small difference between the amount of change in the pressure of the vane pump 10 in response to the degree of the reaction force of the resilient sheet 50 in the case of L7 and the amount of change in the pressure of the vane pump 10 in response to the degree of the reaction force of the resilient sheet 50 in the case of L8. Therefore, in the present embodiment, it is easy to place the suction pressure or discharge pressure of the vane pump 10 immediately after manufacturing thereof in a factory standard range thereof in a span of control of the tightening force of the screw 60 (see FIG. 4D).

As discussed above, in the present embodiment, the resilient sheet 50 has the primary protrusions 55 at the lower casing 30 side surface of the resilient sheet 50. Therefore, the lower casing 30 contacts the resilient sheet 50 through the primary protrusions 55. As a result, the total contact surface area between the resilient sheet 50 and the lower casing 30 is reduced in comparison to the case where the resilient sheet 50 is formed as the planar sheet having the axially opposed smooth planar surfaces like in the case of the comparative example. In this way, it is possible to reduce the amount of change in the reaction force generated in the resilient sheet 50 caused by the application of the tightening force of the screw 60 without increasing the thickness of the resilient sheet 50. Thereby, it is easy to place the value of the suction pressure or discharge pressure of the vane pump 10 within the predetermined factory standard range. Furthermore, since the amount of change in the reaction force generated in the resilient sheet 50 is made small, the assembling of the vane pump 10 is eased to improve the assembly work efficiency. Also, in the present embodiment, it is not required to increase the thickness of the resilient sheet 50 to reduce the amount of change in the reaction force generated in the resilient sheet 50. Therefore, it is possible to limit the increase in the manufacturing costs of the resilient sheet 50. Thus, the vane pump 10 can be manufactured at the low costs. In the present embodiment, the resilient sheet 50 is placed between the lower casing 30 and the mount portion 14 of the motor 11, so that the vibration and the operational noise of the vane pump 10 can be limited at the time of operating the vane pump 10.

Furthermore, in the present embodiment, the secondary protrusions 56 are formed at the lower casing 30 side surface of the resilient sheet 50 where the primary protrusions 55 are formed, and each secondary protrusion 56 surrounds an opening of the corresponding through hole (serving as the tertiary through hole) 51, i.e., circumferentially extends along the peripheral edge of the opening of the corresponding through hole 51 and has the projecting height that is generally the same as that of the primary protrusions 55. The screw 60 is received through the through hole 51, so that the tightening force of the screw 60 is applied to the surrounding area of the resilient sheet 50, which surrounds the through hole 51. In the present embodiment, the secondary protrusion 56 is formed to circumferentially extend along the peripheral edge of the opening of the primary hole 51. Therefore, it is possible to stabilize the reaction force, which is generated in the surrounding area of the resilient sheet 50 that surrounds the opening of the through hole 51. As a result, the degree of fluid tightness (gas tightness or liquid tightness) of the pump chamber 24 is stabilized, and thereby the suction pressure or discharge pressure of the vane pump 10 is stabilized. Furthermore, since the reaction force of the surrounding area of the resilient sheet 50, which surrounds the opening of the through hole 51, is stabilized, it is possible to further improve the vibration attenuation and noise attenuation effect of the resilient sheet 50.

In addition, according to the present embodiment, the resilient sheet 50 includes the center through hole 52, which is placed to correspond with the pump chamber 24 and is configured to correspond with the shape of the opening of the pump chamber 24. Therefore, the lower casing 30 receives the pressure only at the contact area where the lower casing 30 contacts the planar surface portion 204 of the upper casing 20 due to the reaction force of the resilient sheet 50, so that the lower casing 30 tightly contacts the upper casing 20. At this time, the portion of the lower casing 30, which corresponds to the pump chamber 24, does not receive the pressure from the resilient sheet 50 and is thereby not deformed. Thus, it is possible to limit a deformation of the pump chamber 24 and a change in the volume of the pump chamber 24 caused by, for example, aging or long term use.

Also, in the present embodiment, the tertiary protrusion 57 is formed at the lower casing 30 side surface of the resilient sheet 50 where the primary protrusions 55 are formed, and the tertiary protrusion 57 circumferentially extends along the peripheral edge of the opening of the center through hole 52 and has the projecting height that is generally the same as that of the primary protrusions 55. In the present embodiment, since the tertiary protrusion 57 is formed to circumferentially extend along the peripheral edge of the opening of the center through hole 52, it is possible to stabilize the reaction force, which is generated in the surrounding area of the resilient sheet 50, which surrounds the opening of the center through hole 52. The center through hole 52 is placed at the location, which corresponds to the pump chamber 24 and is configured to correspond with the shape of the opening of the pump chamber 24. As a result, the degree of fluid tightness (gas tightness or liquid tightness) of the pump chamber 24, particularly of the surrounding area around the opening of the pump chamber 24 is stabilized, and thereby the suction pressure or discharge pressure of the vane pump 10 is further stabilized. Furthermore, since the reaction force of the surrounding area of the resilient sheet 50, which surrounds the opening of the through hole 51, is stabilized, it is possible to further improve the vibration attenuation and noise attenuation effect of the resilient sheet 50.

Furthermore, in the present embodiment, the lower casing 30 includes the projections 31, each of which axially projects toward the motor 11 side and contacts the mount portion 14 of the motor 11. These protrusions 31 contact the mount portion 14 through the through holes 51, respectively, of the resilient sheet 50. The projecting amount of each projection 31 is set to be smaller than the sum of the thickness of the resilient sheet 50 and the protruding height of each primary protrusion 55 measured in the non-compressed state, i.e., the relaxed state of the resilient sheet 50. In this way, the constant distance between the lower casing 30 and the mount portion 14 can be maintained, and thereby the uniform and constant reaction force, which is applied from the resilient sheet 50 to the lower casing 30, can be maintained.

Furthermore, according to the present embodiment, each projection 31 of the lower casing 30 is formed to surround the opening of the through hole 32, i.e., to circumferentially extend along the peripheral edge of the opening of the through hole 32. That is, in the present embodiment, the through hole 32 is placed radially inward of the projection 31 of the lower casing 30, and the screw 60 is received through this through hole 32. In this way, the tightening force of the screw 60 is applied to the contact surface between the projection 31 and the mount portion 14. Thereby, the distance between the lower casing 30 and the mount portion 14 can be further stably maintained.

Figure 5:
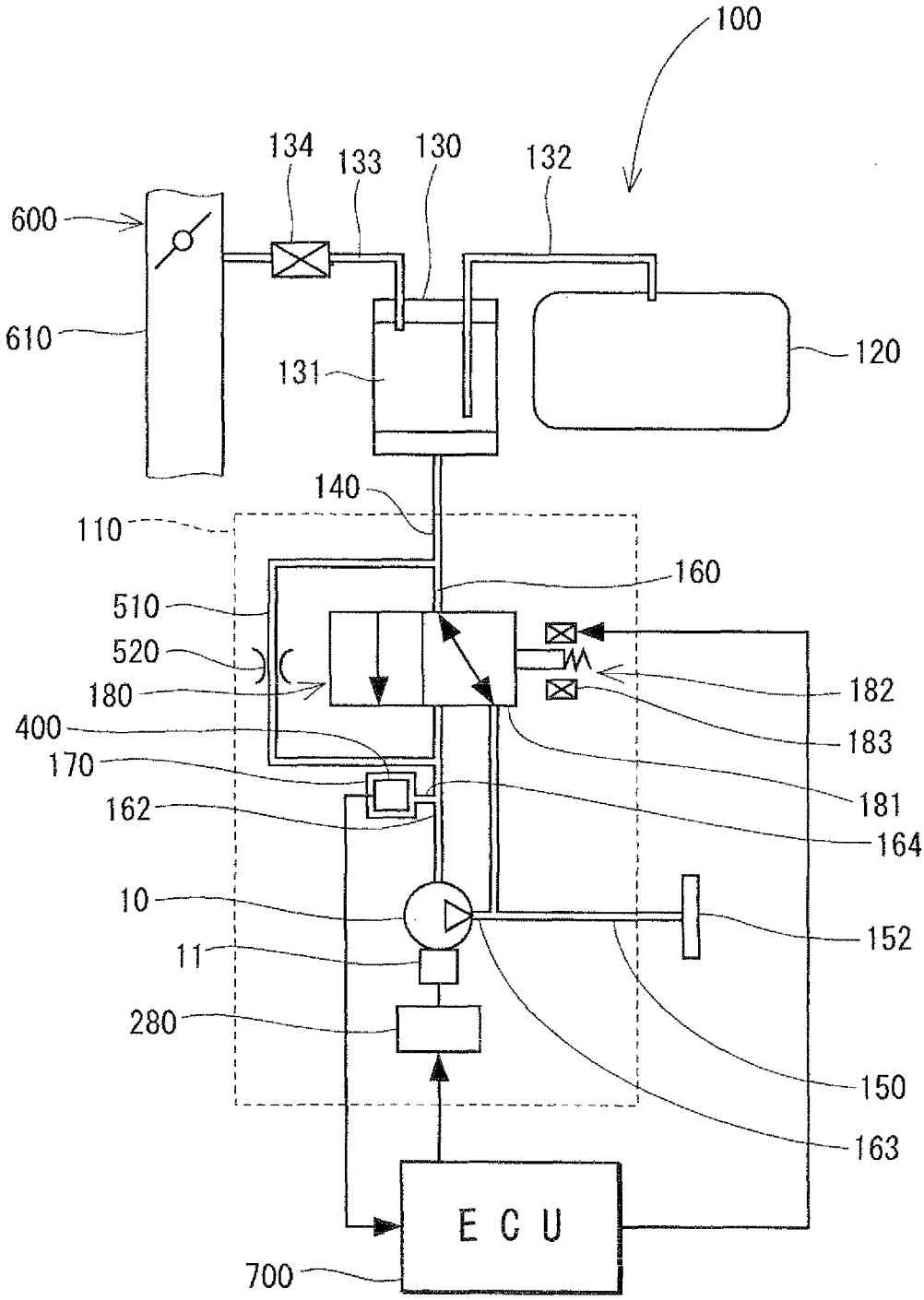
FIG. 5 is a schematic diagram showing an evaporative leak check system having the vane pump of the first embodiment.

Next, an evaporative leak check system (hereinafter, simply referred to as a check system) 100 having the vane pump 10 of the first embodiment will be described with reference to FIG. 5. In this check system 100, the vane pump 10 is used to depressurize an interior of a fuel tank 120.

The check system 100 includes a check module 110, the fuel tank 120, a canister 130, an air intake apparatus 600 and an ECU 700. The check module 110 includes the vane pump 10, the motor 11, a control circuit 280, a switch valve 180 and a pressure sensor 400. The switch valve 180 and the canister 130 are connected with each other through a canister passage 140. An atmosphere communication passage 150 is open to the atmosphere through an open end 152, which is opposite from the check module 110. The canister passage 140 and the atmosphere communication passage 150 are connected with each other through a connection passage 160. The connection passage 160 and the fluid inlet passage 26 of the vane pump 10 are connected with each other through a pump passage 162. The fluid outlet passage 27 of the vane pump 10 and the atmosphere communication passage 150 are connected with each other through a discharge passage 163. A pressure introducing passage 164 is branched from the pump passage 162, and the pressure introducing passage 164 connects between the pump passage 162 and a sensor chamber 170. The pressure sensor 400 is placed in the sensor chamber 170. With the above construction, the pressure of the sensor chamber 170 becomes generally the same as the pressure of the pressure introducing passage 164 and the pressure of pump passage 162.

An orifice passage 510 is branched from the canister passage 140. The orifice passage 510 connects between the canister passage 140 and the pump passage 162. An orifice 520 is placed in the orifice passage 510. A size of an opening of the orifice 520 is set to allow leakage of a permissible amount of air containing fuel vapor from the fuel tank 120.

The switch valve 180 includes a valve main body 181 and a drive device 182. The drive device 182 drives the valve main body 181. The drive device 182 includes a coil 183, which is connected to the ECU 700. The ECU 700 enables and disables the electric power supply to the coil 183. In the case where the electric power is not supplied to the coil 183, the connection passage 160 and the pump passage 162 are disconnected from each other, and the canister passage 140 and the atmosphere communication passage 150 are connected with each other through the connection passage 160. In contrast, in the case where the electric power is supplied to the coil 183, the canister passage 140 and the pump passage 162 are connected with each other, and the canister passage 140 and the atmosphere communication passage 150 are disconnected from each other. The orifice passage 510 and the pump passage 162 are always connected with each other regardless of whether the electric power is supplied to the coil 183 or not.

The canister 130 includes adsorbent 131, such as activated carbon. The canister 130 is placed between the check module 110 and the fuel tank 120 and adsorbs the fuel vapor generated in the fuel tank 120. The canister 130 is connected to the check module 110 through the canister passage 140 and is connected to the fuel tank 120 through a tank passage 132. Furthermore, the canister 130 is connected to a purge passage 133, which is in turn connected to an intake pipe 610 of the air intake apparatus 600. When the fuel vapor, which is generated in the fuel tank 120, passes through the tank passage 132, the adsorbent 131 adsorbs the fuel vapor. A purge valve 134 is placed in the purge passage 133, which connects between the canister 130 and the intake pipe 610 of the air intake apparatus 600. The purge valve 134 opens or closes the purge passage 133 according to a command received from the ECU 700.

The pressure sensor 400 senses a pressure of the sensor chamber 170 and outputs a signal, which corresponds to the sensed pressure, to the ECU 700. The ECU 700 is a microcomputer, which includes a CPU, a ROM and a RAM (not shown). The ECU 700 receives signals, which are outputted from various sensors that include the pressure sensor 400. The ECU 700 controls the corresponding components according to a predetermined control program, which is stored in the ROM, based on these signals.

The electric power is not supplied to the coil 183 during the operation of the engine and also during a predetermined time period after the time of stopping the engine, so that the canister passage 140 and the atmosphere communication passage 150 are connected with each other through the connection passage 160. Therefore, the air, which contains the fuel vapor generated in the fuel tank 120, passes through the canister 130, and the fuel vapor is removed from the air at the canister 130. Thereafter, the air, from which the fuel vapor is removed, is released to the atmosphere through the open end 152 of the atmosphere communication passage 150.

Upon elapsing of the predetermined time period from the time of stopping the engine of the vehicle, the check operation for checking a leakage of the air, which contains the fuel vapor from the fuel tank 120, starts. In the check operation, the atmospheric pressure is sensed for the purpose of correcting an error caused by an altitude of a location where the vehicle is parked. The atmospheric pressure is sensed with the pressure sensor 400, which is placed in the sensor chamber 170. When the electric power is not supplied to the coil 183, the atmosphere communication passage 150 and the pump passage 162 are connected with each other through the orifice passage 510. The pressure of the sensor chamber 170, which is connected to the pump passage 162 through the pressure introducing passage 164, is generally the same as the atmospheric pressure. Therefore, the atmospheric pressure is sensed with the pressure sensor 400 placed in the sensor chamber 170.

After completion of the sensing of the atmospheric pressure, the altitude of the location, at which the vehicle is parked, is computed based on the sensed atmospheric pressure. The ECU 700 corrects various parameters based on the computed altitude. Upon completion of the correction of the various parameters, the ECU 700 supplies the electric power to the coil 183 of the switch valve 180. When the electric power is supplied to the coil 183, the valve main body 181 of the switch valve 180 is driven toward the right side in FIG. 5. Thereby, the switch valve 180 closes the connection between the atmosphere communication passage 150 and the canister passage 140 and opens the connection between the canister passage 140 and the pump passage 162. Therefore, the sensor chamber 170, which is connected to the pump passage 162, is connected to the fuel tank 120 through the canister 130. In the case where the fuel vapor is generated in the fuel tank 120, the pressure of the interior of the fuel tank 120 is higher than the atmospheric pressure around the vehicle.

When the pressure increase, which is caused by the generation of the fuel vapor in the fuel tank 120, is sensed, the ECU 700 stops the electric power supply to the coil 183 of the switch valve 180. When the electric power supply to the coil 183 is stopped, the pump passage 162 is connected to the canister passage 140 and the atmosphere communication passage 150 through the orifice passage 510. Furthermore, the canister passage 140 and the atmosphere communication passage 150 are connected with each other through the connection passage 160.

At this stage, when the electric power is supplied to the motor 11 through the control circuit 280, the vane pump 10 is driven. Thereby, the pump passage 162 is depressurized. Thus, the air, which is supplied from the atmosphere communication passage 150, flows to the pump passage 162 through the orifice passage 510. The flow of the air, which is supplied to the pump passage 162, is throttled, i.e., choked through the orifice 520 of the orifice passage 510, so that the pressure of the pump passage 162 is reduced. The pressure of the pump passage 162 is reduced to a predetermined pressure, which corresponds to a cross-sectional area of the opening of the orifice 520, and thereafter becomes constant. At this time, the sensed pressure of the pump passage 162 is recorded, i.e., stored as a reference pressure. Upon completion of the sensing of the reference pressure, the electric power supply to the motor 11 is stopped.

Once the reference pressure is sensed, the electric power is supplied to the coil 183 of the switch valve 180 again. In this way, the connection between the atmosphere communication passage 150 and the canister passage 140 is closed, and the connection between the canister passage 140 and the pump passage 162 is opened. Therefore, the fuel tank 120 and the pump passage 162 are connected with each other, and the pressure of the pump passage 162 becomes the same as the pressure of the fuel tank 120. Then, when the electric power is supplied to the motor 11 through the control circuit 280, the vane pump 10 is driven. When the vane pump 10 is driven, the interior of the fuel tank 120 is depressurized. At this time, the pump passage 162 is connected to the fuel tank 120. Therefore, the pressure, which is sensed with the pressure sensor 400 placed in the sensor chamber 170 that is connected to the pump passage 162, is generally the same as the pressure of the interior of the fuel tank 120.

When the pressure of the sensor chamber 170, i.e., the pressure of the interior of the fuel tank 120 becomes lower than the reference pressure through the continuous operation of the vane pump 10, it is determined that a level of the leakage of the air, which contains the fuel vapor generated from the fuel tank 120, becomes equal to or smaller than a permissible threshold level. That is, when the pressure of the interior of the fuel tank 120 is reduced below the reference pressure, it is assumed that the air is not introduced from the outside into the interior of the fuel tank 120, or the flow quantity of the air introduced from the outside into the interior of the fuel tank 120 is equal to or smaller than the flow quantity of the air passing through the orifice 520. Therefore, it is determined that a sufficient level of the airtightness of the fuel tank 120 is maintained.

In contrast, when the pressure of the interior of the fuel tank 120 is not reduced to the reference pressure, it is determined that the leakage of the air containing the fuel vapor from the fuel tank 120 is above the permissible threshold level. That is, when the pressure of the interior of the fuel tank 120 is not reduced to the reference pressure, it is assumed that the air is introduced from the outside into the interior of the fuel tank 120 in response to the depressurization of the interior of the fuel tank 120. Therefore, it is determined that the sufficient level of the airtightness of the fuel tank 120 is not maintained.

Upon completion of the check operation for checking the leakage of the air, which contains the fuel vapor, the electric power supply to the motor 11 and the switch valve 180 is stopped. When the ECU 700 senses that the pressure of the pump passage 162 is returned to the atmospheric pressure, the ECU 700 stops the operation of the pressure sensor 400 and terminates the check process.

As discussed above, in the case of the vane pump 10 of the first embodiment, it is easy to place the suction pressure or discharge pressure of the vane pump 10 after manufacturing thereof in the predetermined factory standard range thereof. Therefore, in the case where the vane pump 10 of the first embodiment is applied to the check system 100, the depressurization of the interior of the fuel tank 120 with the suction pressure, which is in the predetermined factory standard range, can be easily achieved. Thus, at the check system 100, the stable check result can be obtained immediately upon the starting of the operation of check system 100.

Second Embodiment

Figure 6:
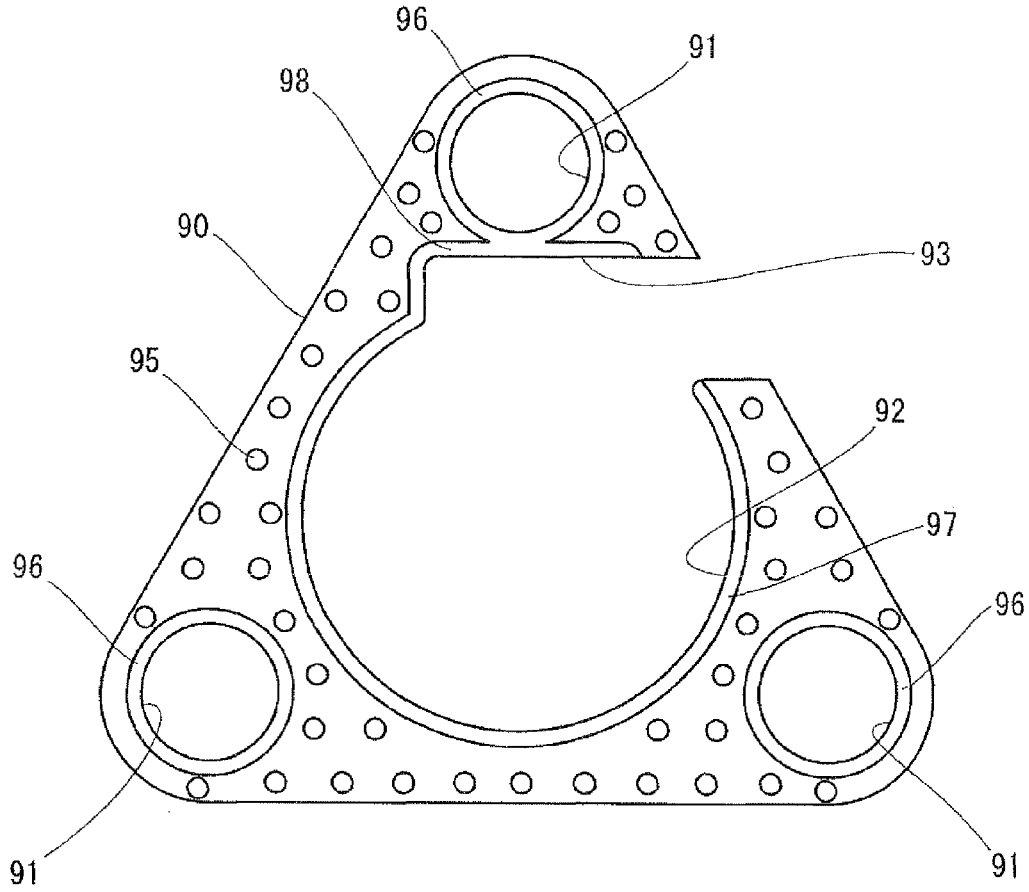
FIG. 6 is a schematic view of a resilient sheet of a vane pump according to a second embodiment of the present invention.

FIG. 6 shows a resilient sheet of a vane pump according to a second embodiment of the present invention. The second embodiment is substantially the same as that of the first embodiment except the configuration of the resilient sheet.

In the second embodiment, similar to the resilient sheet 50 of the first embodiment, the resilient sheet 90 is placed between the lower casing 30 and the mount portion 14 of the motor 11. The resilient sheet 90 is configured into a plate form (sheet form) and is formed from a material (e.g., rubber), which has a resiliency and a large attenuation coefficient. The resilient sheet 90 has three through holes (serving as tertiary through holes) 91, which are provided at three locations, respectively, that correspond to the through holes 32, respectively, of the lower casing 30. An inner diameter of each through hole 91 is generally the same as or slightly larger than the outer diameter of the corresponding projection 31.

In the first embodiment, the resilient sheet 50 has the center through hole 52 at the center part of the resilient sheet 50, and the resilient sheet 50 is configured into the corresponding shape that corresponds to the shape of the planar surface portion 204 of the upper casing 20. In contrast, according to the second embodiment, as shown in FIG. 6, the resilient sheet 90 has a notch (cut) 93, which connects between the center through hole 92 and the outer peripheral edge of the resilient sheet 90. In the present embodiment, a through hole, which connects between the notch 93 and the pump chamber 24, is formed, and this through hole is made as a part of the fluid inlet passage 26 or the fluid outlet passage 27. In this way, it is possible to increase the fluid tightness (the gas tightness or liquid tightness) of the pump chamber 24, and the fluid inlet passage 26 or the fluid outlet passage 27 can be provided at the notch 93 instead of the location between the upper casing 20 and the lower casing 30.

The resilient sheet 90 includes the primary protrusions 95 on the lower casing 30 side surface of the resilient sheet 90. Each primary protrusion 95 is configured into a generally semispherical form and protrudes toward the lower casing 30 side in the axial direction. Furthermore, the resilient sheet 90 further includes the secondary protrusions 96 on the lower casing 30 side surface of the resilient sheet 50, on which the primary protrusions 95 are formed. A projecting height of each secondary protrusion 96 measured in the axial direction is generally the same as that of the primary protrusion 95. The secondary protrusion 96 is configured into a generally annular form, which circumferentially extends along the peripheral edge of the opening of the corresponding through hole 91.

The resilient sheet 90 further includes a tertiary protrusion 97, which is formed at the lower casing 30 side surface of the resilient sheet 90 where the primary protrusions 95 are formed. A projecting height of the tertiary protrusion 97 is generally the same as that of the primary protrusion 95. The tertiary protrusion 97 is configured to circumferentially extend along the peripheral edge of the opening of the center through hole 92.

Furthermore, in the present embodiment, a quaternary protrusion 98 is formed at the lower casing 30 side surface of the resilient sheet 90 where the primary protrusions 95 are formed. A projecting height of the quaternary protrusion 98 is generally the same as that of the primary protrusion 95. The quaternary protrusion 98 is formed to circumferentially extend along the peripheral edge of the notch 93. In the present embodiment, the quaternary protrusion 98 is connected to, i.e., is joined to one of the secondary protrusions 96 and is also connected to, i.e., is joined to the tertiary protrusion 97.

As discussed above, according to the second embodiment, the total contact surface area between the resilient sheet 90 and the lower casing 30 is reduced in comparison to the case where the resilient sheet is formed as the planar sheet having the axially opposed smooth planar surfaces. In this way, it is possible to reduce the amount of change in the reaction force generated in the resilient sheet 90 caused by the application of the tightening force of the screw 60 without increasing the thickness of the resilient sheet 90. Thus, similar to the first embodiment, it is easy to place the suction pressure or discharge pressure of the vane pump after the manufacturing thereof in the predetermined factory standard range thereof.

Now, modifications of the above embodiments will be described.

In a modification of the above embodiments, the primary protrusions 55, 95, the secondary protrusions 56, 96 and the tertiary protrusion 57, 97 may be provided to the other side surface of the resilient sheet 50, 90, which is opposite from the lower casing 30 or may be provided to both of the lower casing 30 side surface and the other side surface of the resilient sheet 50, 90. Furthermore, the resilient sheet 50, 90 may have only the primary protrusions 55, 95 or may have only the primary protrusions 55, 95 and the secondary protrusions 56, 96. Also, the resilient sheet 50, 90 may have only the primary protrusions 55, 95 and the tertiary protrusion 57, 97. That is, the primary protrusions 55, 95, the secondary protrusions 56, 96 and the tertiary protrusion 57, 97 may be provided in any combination in the resilient sheet 50, 90. Also, the resilient sheet 50, 90 may be constructed without forming the center through hole 52, 92, which corresponds to the shape of the opening of the pump chamber 24.

Furthermore, in another modification of the above embodiments, the shape of each primary protrusion 55, 95 is not limited to the semispherical shape and may be modified to any other suitable shape, such as a circular cone shape, a polygonal cone shape, a circular cylindrical shape, or a polygonal column shape.

Also, in another modification of the above embodiments, each secondary protrusion 56, 96 may be configured to circumferentially extend only a part of the peripheral edge of the opening of the corresponding through hole 51, 91.

Furthermore, in another modification of the above embodiments, each projection 31 of the lower casing 30 may be configured to circumferentially extend along only a part of the peripheral edge of the opening of the corresponding through hole 32 of the lower casing 30. Also, the projection 31 may be placed at a location radially spaced from the through hole 32 and may be formed into any suitable configuration. In such a case, this relocated projection may contact the mount portion 14 of the motor through another corresponding through hole, which is formed for this projection in the resilient sheet 50, 90. Furthermore, the projections 31 may be entirely eliminated from the lower casing 30.

In the above embodiments, the present invention is applied to the check system, which is used to check the leakage of the fuel vapor by depressurizing the interior of the fuel tank. Alternatively, the present invention may be applied to a check system, which is used to check the leakage of fuel by pressuring the interior of the fuel tank. Further alternatively, the present invention may be applied to various known apparatuses or systems, which involve depressurization or pressurization of fluid.

As discussed above, the present invention is not limited to the above embodiments, and the above embodiments and the modifications thereof may be further modified within the spirit and scope of the present invention.

What is claimed is:

1. A vane pump comprising:

an electric motor that includes a mount portion;

a rotor that includes a plurality of vanes and is adapted to be rotated together with the plurality of vanes by a rotational drive force of the electric motor;

an upper casing that rotatably receives the rotor and includes:

a pump chamber that has an inner peripheral wall, along which the plurality of vanes slides to draw fluid into the pump chamber and to discharge the fluid pressurized in the pump chamber out of the pump chamber upon rotation of the rotor;

a primary planar surface portion that is formed around an opening of the pump chamber; and a primary through hole that penetrates through the primary planar surface portion;

a lower casing that includes:

a secondary planar surface portion that is joined to the primary planar surface portion; and a secondary through hole that extends through the secondary planar surface portion at a location, which corresponds to the primary through hole, wherein the lower casing closes the opening of the pump chamber to form the pump chamber in cooperation with the upper casing;

a resilient sheet that is placed between the lower casing and the mount portion and includes a tertiary through hole at a location, which corresponds to the secondary through hole; and a screw member that is received through the primary through hole, the secondary through hole and the tertiary through hole to securely connect the upper casing, the lower casing and the resilient sheet to the mount portion, wherein:

at least one of two opposed surfaces of the resilient sheet, which are opposed to each other in a direction perpendicular to a plane of the resilient sheet, includes a plurality of primary protrusions;

a secondary protrusion is formed in the at least one of the two opposed surfaces of the resilient sheet and is configured to circumferentially extend all around an entire peripheral edge of an opening of the tertiary through hole; and the secondary protrusion has a projecting height that is generally the same as a projecting height of each of the plurality of primary protrusions.

2. The vane pump according to claim 1, wherein a hole is formed in the resilient sheet at a location, which corresponds the pump chamber and has a shape that corresponds to a shape of the opening of the pump chamber.

3. The vane pump according to claim 2, wherein a tertiary protrusion is formed in the at least one of the two opposed surfaces of the resilient sheet to circumferentially extend along a peripheral edge of an opening of the hole and has a projecting height that is generally the same as a projecting height of each of the plurality of primary protrusions.

4. The vane pump according to any claim 1, wherein:

the lower casing includes a projection, which projects toward the electric motor and contacts the mount portion; and the projection has an amount of projection that is smaller than a sum of a thickness of the resilient sheet, which is measured in a relaxed state of the resilient sheet, and a projecting height of each of the plurality of primary protrusions.

5. The vane pump according to claim 4, wherein the projection is formed to circumferentially extend along a peripheral edge of an opening of the secondary through hole.

6. An evaporative leak check system comprising the vane pump of claim 1, which is adapted to depressurize or pressurize an interior of a fuel tank to check leakage of fuel vapor from the fuel tank.

* * * * *